US005222314A

United States Patent [19]

Inteso

[11] Patent Number: 5,222,314

[45] Date of Patent: Jun. 29, 1993

[54] FABRIC HOLD-DOWN DEVICE

[76] Inventor: Ronald Inteso, 6311 DeSoto Ave., Unit L, Woodland Hills, Calif. 91367

[21] Appl. No.: 848,077

[22] Filed: Mar. 9, 1992

[51] Int. Cl.[5] ..... D05C 9/04; D06C 3/08

[52] U.S. Cl. ..... 38/102.2; 38/102.91; 112/103; 160/380

[58] Field of Search ..... 112/103, 119, 121.15; 38/102.2, 102.1, 102.4, 102.91; 160/380, 378; 101/127.1; 223/63, 69; 242/67.3 F, 74.2

[56] References Cited

U.S. PATENT DOCUMENTS 4,411,208 10/1983 Nishida et al. ..... 38/102.2 X
4,485,574 12/1984 Bennetot ..... 38/102.2
4,660,308 4/1987 Dang et al. ..... 38/102.91
4,677,775 7/1987 Riley ..... 38/102.2

*Primary Examiner*—Peter Nerbun

[57] ABSTRACT

A fabric hold-down device is disclosed herein having a base frame provided with a continuous side wall defining a central open area adapted to receive a fabric work piece having edge marginal regions overhanging the frame side wall. A first resilient retention device is employed having a yieldable biased arm carried on a stationary member so as to be insertably disposed into the frame against the fabric edge marginal region to bear against the inner surface of opposite side portions of the side wall. A second resilient retention device is similar to the first retention device which is insertably disposed in the central area to bear against opposite end portions of the side wall to retain the fabric work piece in a taut condition preparatory for subsequent sewing or embroidery procedures.

4 Claims, 1 Drawing Sheet

FABRIC HOLD-DOWN DEVICE

BACKGROUND OF THE INVENTION

1. Field of the Invention

The present invention relates to the field of fabric retention devices, and more particularly to a novel frame for supporting a fabric work piece and which incorporates a pair of resilient retention devices that are disposed over the fabric work piece so as to yieldably urge the edge marginal regions of the work piece into taut retention against the stationary frame.

2. Brief Description of the Prior Art

In the past, it has been the conventional practice to hold a fabric work piece in position preparatory for subsequent sewing or embroidery procedures which generally employ many manual and/or automatic movable parts which are incorporated into sewing or embroidery machinery. In this connection, the cost is extremely expensive and generally requires trained technicians to operate and manipulate the fabric work piece in such a manner that it will be held taut and fully retained by the apparatus. Problems and difficulties have been encountered when employing such devices, which stem largely from the fact that the prior devices are limited to certain thicknesses of fabric material so that they are not universal or adapted to accommodate fabric work pieces of varying thickness. In actual practice, such fabric hold-down devices must accommodate fabric as thin as shirt material, as well as fabric thicknesses composed of quilted or filled fabric, such as encountered in jackets, coats or the like. The thickness of the material being worked upon resists retention and usually after the artisan has commenced the sewing or embroidery procedure, slippage occurs causing the artisan to reset or readjust the retention device. Such slippage of the material often causes improper design placement on the fabric and the damaged goods must be recycled.

Therefore, a long-standing need has existed to provide a novel means for retaining fabric of varying thicknesses in a stationary device whereby an artisan may readily perform sewing or embroidery procedures on the fabric while the fabric is maintained in a taut and fully stationary position. Such means must be readily installed and operated by unskilled personnel and the device should be of low cost and of few operating parts.

SUMMARY OF THE INVENTION

Accordingly, the above problems and difficulties are obviated by the present invention which provides a novel resilient retention means for holding a fabric work piece in a taut condition and to hold it stationary while the artisan works on the fabric. In one form of the invention, a stationary base frame is provided having a continuous side wall defining a central area or opening over which the fabric work piece is to be held during the sewing or embroidery procedure. The fabric work piece includes edge marginal regions which overlap the periphery of the stationary frame. A first resilient retention device is inserted into the central area so as to forcibly urge the fabric edge marginal region against the side portions of the side wall, followed by the insertion of a second resilient retention device forcibly urging the edge marginal region of the fabric work piece into contact with the end portions of the side wall. Thus, the edge marginal region of the fabric work piece is captured by the retention devices and held taut over the central area so that the artisan can work on the fabric. Antislip means are provided on the retention devices to deter slippage of the edge marginal regions of the fabric work piece and resilient means are incorporated into each of the respective retention devices for releasably urging the devices in a clamping action so that the fabric edge marginal regions are held between the retention devices and the stationary frame side wall.

Therefore, it is among the primary objects of the present invention to provide a novel resilient retaining device for releasably securing the fabric work piece in a stationary position so that an artisan may work on a taut and captured fabric work piece.

Another object of the present invention is to provide a novel retention means for holding the edge marginal regions of a fabric work piece so that the area of the work piece to be worked upon is maintained in a taut and secure condition on a stationary frame.

Still a further object of the invention is to provide a novel fabric retention device which employs fewer number of parts and which is more economical than conventional devices which require skill and effort on behalf of an artisan to maintain the fabric taut and properly secured.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
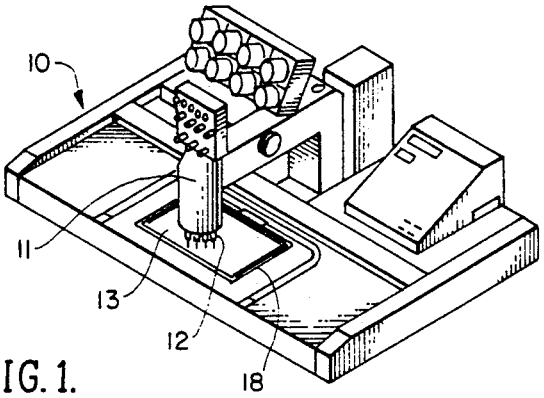
FIG. 1 is a front perspective view of a conventional sewing or embroidering apparatus incorporating the fabric work piece hold-down device of the present invention.

Referring to FIG. 1, an automatic embroidering machine is identified by numeral 10 which includes a programmable sewing head 11 having a plurality of sewing needles 12 downwardly depending therefrom intended for engagement with the fabric of wearing apparel, such as a T-shirt, jacket or the like. The various controls on the machine 10 are employed for selectively directing the embroidery or sewing head 11 across longitudinal and transverse axes so that the needles 12 will produce the desired design in the fabric of the work piece. In this connection, an area is selected on the fabric work piece, such as a garment, and this area is held taut by means of the novel fabric work piece hold-down apparatus of the present invention. In general, numeral 13 identifies an assembled hold-down apparatus which is placed on the machine 10 with the fabric of the garment located beneath the needles 12. The garment is not shown in FIG. 1 since it does not form a part of the present invention.

Figure 2:
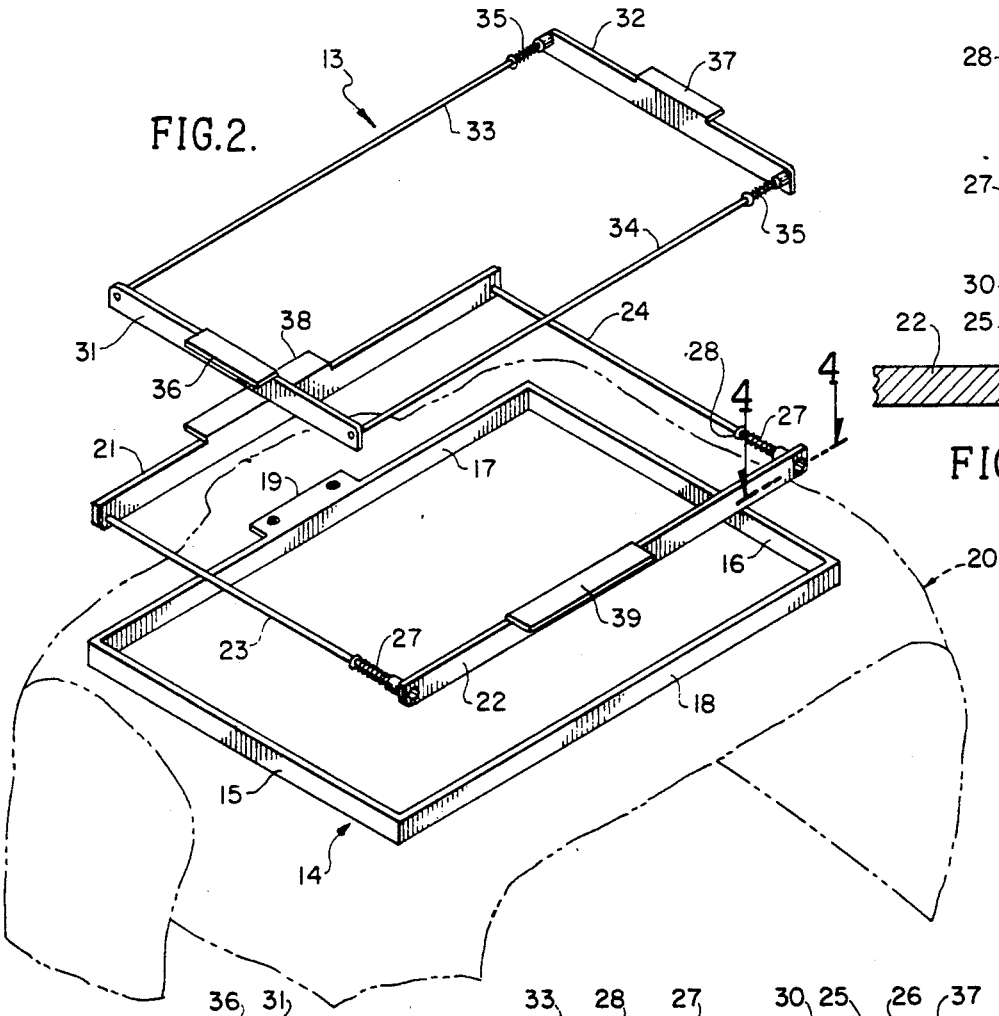
FIG. 2 is an enlarged exploded perspective view of the novel resilient retention device of the present invention as used in the apparatus of FIG. 1.
Figure 4:
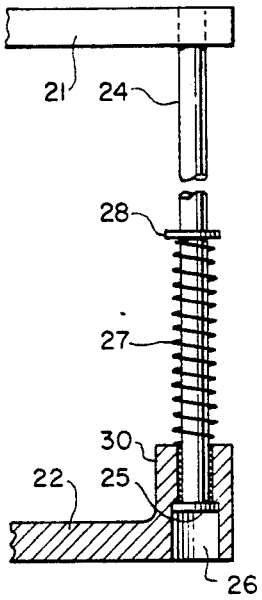
FIG. 4 is a sectional view of a resilient retaining device as taken in the direction of arrows 4—4 of FIG. 2.

Referring now in detail to FIG. 2, the inventive fabric work piece hold-down apparatus of the present invention is illustrated in the general direction of arrow 13 which is illustrated in a disassembled, exploded view. The apparatus comprises a rectangular frame 14 having a continuous side wall composed of end portions 15 and 16 and longitudinal side portions 17 and 18 respectively. The work area is defined between the opposing inner surface of the side wall portions and a bracket 19 is employed for releasably securing the frame to the machine 10. The fabric work piece, such as a quilted jacket, is broadly identified by numeral 20 and the jacket is placed over the frame 18 prior to assembly with a pair of retention devices which hold the fabric work piece in position on the frame 18.

Figure 3:
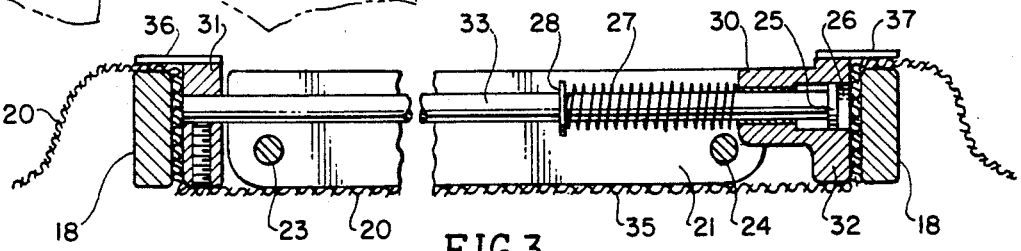
FIG. 3 is a transverse cross-sectional view of the resilient retention device illustrated in an assembled condition for releasably securing a fabric work piece in position.

A first retention device includes a pair of side members 21 and 22 which are held in spaced-apart relationship by means of rods 23 and 24 having their opposite ends connected to the ends of the rigid members 21 and 22 respectively. The rods are movably coupled to the ends of rigid member 22 by means of a plunger fit, as shown in FIG. 3 by numeral 25. The plunger fitting 25 is slidably located in a cavity 26 located on the end of member 22. A resilient compression spring 27 is compressed between a stop 28 and the end of a projection 30 so that the rigid member 21 is normally biased away from the rigid member 22. Inasmuch as springs 27 are on both rods 23 and 24, the member 21 is evenly biased towards the side wall portion 17 and the side wall portion 18. The device may be moved in and out of engagement with the frame by manually compressing the springs 27 and removing the first device from its location in the working area.

Referring further to FIG. 2, a second retention device is illustrated which is substantially similar to the first retention device with the exception that rigid end members 31 and 32 are coupled together by rods 33 and 34 and are under the expansion control of springs 35 so as to cause the end members 31 and 32 to normally bias outwardly towards the end portions 15 and 16 of the frame 18. The second retention device is intended to be stalled in the work area over the first retention device and towards this end, the rods 33 and 34 are offset from the rods 23 and 24, as shown more clearly in FIG. 3. Inasmuch as the first retention device is the first device to be installed of the pair, rods 23 and 24 will be closer to the fabric 20 than the rods 33 and 34 which will be immediately above the rods. However, it is to be understood that the spring-biasing means, including the stops, plunger and cavity, are identical and therefore like numerals are employed with respect to the pair of retention devices.

FIG. 3 illustrates that the fabric 20 is trained over the side wall of frame 18 and it is pressed against the inner surface of the frame by the first and second retention means so that the fabric is held taut within the work area, and this portion of the fabric work piece is identified by numeral 5 in FIG. 3. The material or fabric is further held in position by means of tabs, such as tabs 36 and 37 associated with the second retention means as well as in cooperation with tabs 38 and 39 associated with the first retention device. These tabs bear against the fabric forcing it in a clamp-like relationship with the upper surface of the frame 18 side wall portions when the devices are installed over the fabric preparatory for the embroidery procedure.

In view of the foregoing, it can be seen that a selected portion of a relatively thick fabric garment can be accommodated by the frame 18 and held in position by means of the resilient and rigid members of the respective retention devices. The springs 27 will accommodate a variety of thickened work pieces, such as quilted material or other fiber filled materials. The outwardly expanding resilient means, as well as the clamping tabs, hold the material taut and prevent creeping or slippage of the material as the embroidery procedure places pressure on the work area of the fabric.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A fabric hold-down apparatus comprising:

a frame having a continuous side wall defining a central open work area;

a first retention device having adjustable means adapted to fit within said central open work area and yieldably expandable outwardly towards said continuous side wall;

a second retention device having adjustable means adapted to fit within said central open work area in offset relationship with respect to said first retention device and yieldably expandable outwardly towards said continuous side wall;

said first and said second retention devices cooperating together to forcibly urge fabric against said continuous side wall;

each of said retention devices includes a pair of elongated rigid members having opposite and opposing ends movably coupled together by a pair of spaced-apart rods; and said pair of rods on said first retention device offset from said pair of rods on said second retention device whereby said pair of retention devices nest together in said central work area.

2. The invention as defined in claim 1 including:

spring-biasing means carried on each of said rods normally and yieldably urging said rigid members apart.

3. The invention as defined in claim 2 wherein:

said spring-biasing means includes a cavity in the end of each rigid member occupied by a sliding plunger carried on the end of said rod;

a stop fixed on each rod in spaced relationship to said member; and a compressed spring disposed between said stop and said member.

4. The invention as defined in claim 3 including:

each of said rigid members having an outwardly extending tab constituting a clamp bearing fabric disposed between said retention devices and said frame against said frame.

* * * * *